United States Patent [19]

Priem

[11] Patent Number: 4,836,272

[45] Date of Patent: Jun. 6, 1989

[54] MOLD CAVITY GAS REMOVAL SYSTEM WITH VALVE POSITION SENSOR

[75] Inventor: Barry L. Priem, Bedford, Ind.

[73] Assignee: General Motors Corporation, Detroit, Mich.

[21] Appl. No.: 262,157

[22] Filed: Oct. 19, 1988

Related U.S. Application Data

[63] Continuation of Ser. No. 132,076, Dec. 11, 1987, abandoned.

[51] Int. Cl.[4] ..... B22D 17/14

[52] U.S. Cl. ..... 164/457; 164/305; 164/410; 425/420; 425/812

[58] Field of Search ..... 164/305, 410, 457, 113; 425/420, 812

[56] References Cited

U.S. PATENT DOCUMENTS 4,463,793 8/1984 Thurner ..... 164/155

4,538,666 9/1985 Takeshima et al. ..... 164/305

*Primary Examiner*—Kuang Y. Lin

*Attorney, Agent, or Firm*—Douglas D. Fekete

[57] ABSTRACT

A gas removal system for a mold cavity of a die casting or other molding machine includes a valve movable to an open position to interconnect the mold cavity to a gas venting or evacuating device or to a closed position. A portion of the valve is movable relative to a fluid pressure supply inlet port to establish a first pressure condition represented by back pressure in the supply line when the valve is in one of the open or closed positions and a second pressure condition represented by substantial absence of back pressure in the supply line when the valve is in the other of those positions. The presence or absence of back pressure in the supply line is sensed to determine valve position. A control unit compares the second valve position and a scheduled valve position and indicates when the valve is improperly positioned to prevent injection of a melt into the mold cavity.

13 Claims, 2 Drawing Sheets

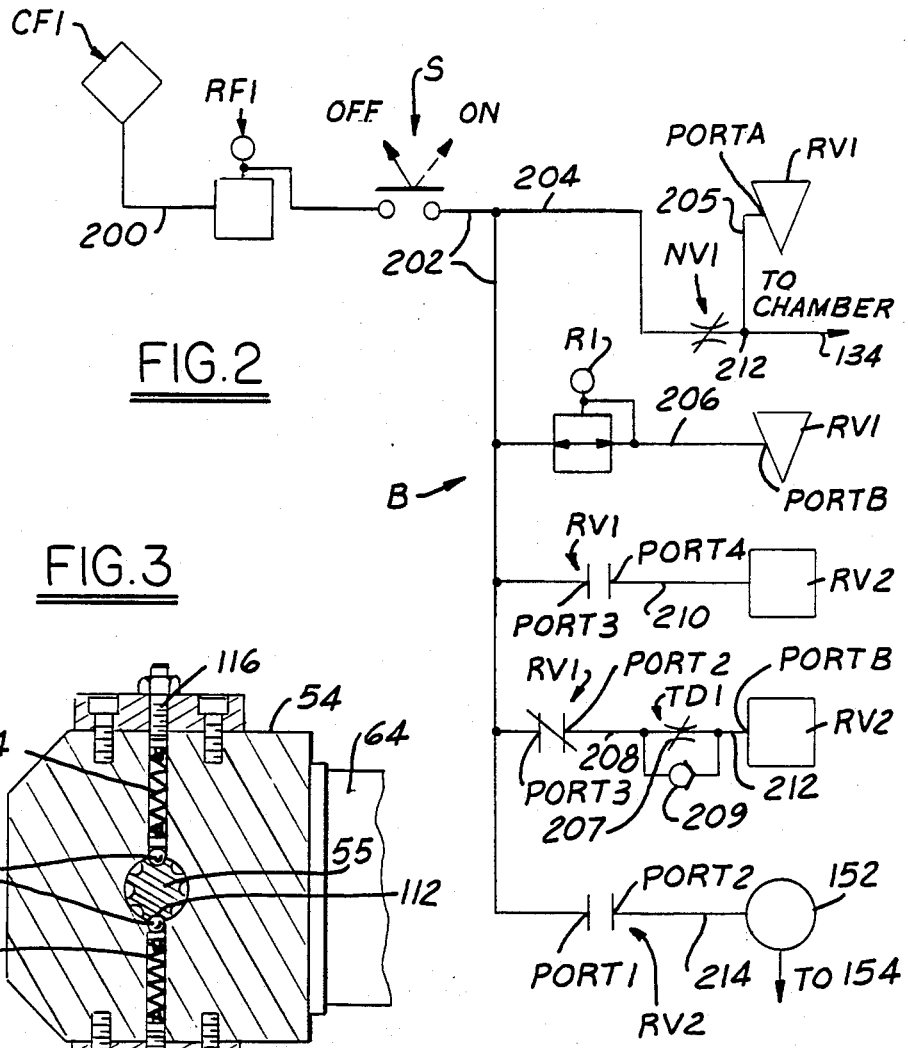
FIG.2
FIG.3
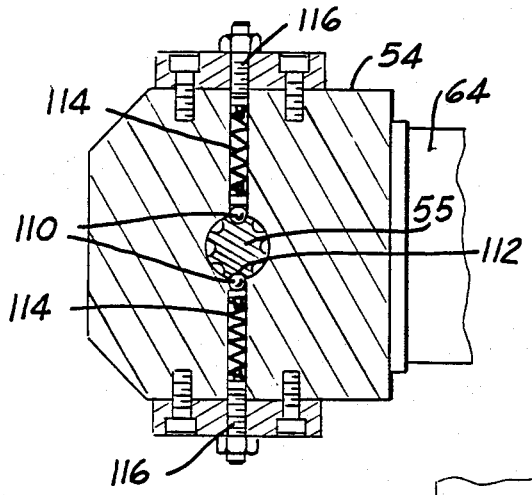
FIG.4
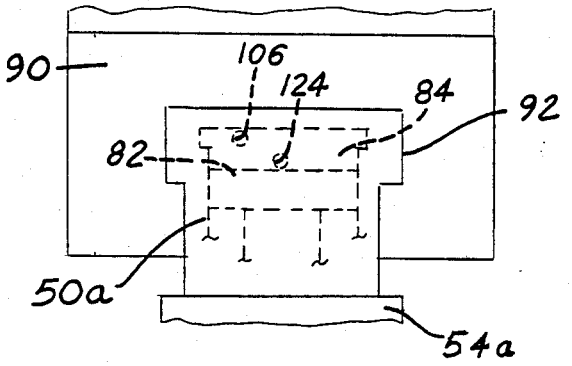

MOLD CAVITY GAS REMOVAL SYSTEM WITH VALVE POSITION SENSOR

This is a continuation of application Ser. No. 132,076 filed on Dec. 11, 1987, now abandoned.

FIELD OF THE INVENTION

The present invention relates to system for removing gas from the mold cavity of a die casting machine or other molding machine and, in particular, to a gas removal system having a control valve movable to an open position for interconnecting the mold cavity to gas removal means or to a closed position for preventing such interconnection and further having a mechanism for sensing valve open or closed positions.

BACKGROUND OF THE INVENTION

It is know in the metal die casting industry to employ a gas venting system of the axial melt impingement type. The system includes a valve movable to an open position where the die or mold cavity is in communication with a gas vent passage to the outside or to a closed position where the mold cavity is not in such communication. As the gas venting system is engaged on the mold during normal operation after mold warm-up, the valve is moved to the open position by application of pneumatic pressure to a cylinder in which a valve extension remote from the valve head is slidably received as a piston. After positioning in the open position, the valve is held in the open position mechanically by engagement of spring biased balls against an intermediate stem portion of the valve. Pneumatic pressure in the cylinder is discontinued once the valve is so engaged and held in open position. A molten charge in then injected into the mold cavity with gas in the cavity being vented past the open valve. The valve is closed by impingement of the molten charge on the valve head after gas is substantially vented from the cavity. A return spring assists return of the valve to the closed position after initial melt impingement on the valve head.

A problem occurs when the valve is not in the proper position during critical stages of the casting or molding sequence, as, for example, a valve closed position during mold cavity fill blocks gas from venting.

SUMMARY OF THE INVENTION

The invention contemplates a gas removal system for removing gas from the mold cavity of a die casting or other machine wherein the gas removal system includes a valve movable to a closed position or to an open position for permitting removal of gas from the mold cavity and also includes a valve position sensing mechanism to determine valve position.

The invention further contemplates such a gas removal system wherein movement of the valve of the gas removal system to one of the closed or open positions established a first pressure condition, such as back pressure in a fluid pressure supply line, and movement of the valve to the other position established a second pressure condition, such as no substantial back pressure in the supply line, such that valve position can be determined by sensing the established pressure condition.

In a typical working embodiment of the invention, the valve position sensing mechanism includes a chamber in which a portion of the valve moves to a first position corresponding to a valve open position or to a second position corresponding to a valve closed position. The valve open position places the mold cavity, such as a die casting cavity, in gas flow communication with gas discharge means, whereas the valve closed position prevents communication of the mold cavity with the gas discharge means. The gas discharge means may comprise a gas discharge passage to outside the mold cavity or to a source of relative vacuum to evacuate gas from the mold cavity.

A fluid pressure supply and fluid pressure exhaust, such as a pneumatic pressure supply and exhaust, have a respective inlet port and outlet port in communication with the chamber. The pressure inlet port is positioned to be blocked off by the valve portion when it is moved to the second position (valve close position) and to be open to the chamber when the valve portion is in the first position (valve open position). When the valve is in the closed position, back pressure builds up or increases in the supply line by virtue of the blocking off of the inlet port. When the valve is at the open position, fluid pressure is introduced to the chamber through the inlet port and is exhausted through the outlet port of the exhaust so that little or no back pressure is created in the supply line. A fluid pressure sensor senses the presence or absence of back pressure in the supply line and thus determines the position of the valve in the closed or open position.

In a preferred embodiment of the invention, means is provided for comparing the sensed valve position and a scheduled valve position stored in the memory of a control unit and indicating when the valve is not in proper position.

In another preferred embodiment of the invention, the chamber in which the portion of the valve moves comprises a fluid cylinder for moving the valve portion therein as a piston. The chamber includes a second fluid pressure supply inlet port for introducing fluid pressure, such as pneumatic pressure, to move the valve from the closed position to the open position as required to allow gas removal from the mold cavity. Preferably, the second inlet port is connected alternately to a fluid pressure exhaust after the valve is opened and such that the port functions as an exhaust port when valve position is sensed. In effect, the second inlet port serves a dual function as a fluid pressure inlet port to effect movement of the valve from the closed position to the open position and as a fluid pressure outlet or exhaust port at other times, especially during valve position sensing.

The invention also contemplates a method for removing gas from a mold cavity wherein the position of the valve in the open or closed position is sensed by supplying fluid pressure to an inlet port, moving the valve relative to the inlet port to create a first pressure condition, such as back pressure, when the valve is in one of the positions and a second pressure condition, such as substantially no detectable back pressure, when the valve is in the other of the positions, and sensing the pressure condition to determine valve position.

BRIEF DESCRIPTION OF THE DRAWINGS

FIG. 2 is a schematic illustration of the pneumatic logic control system of the invention.

FIG. 3 is a cross-sectional view taken along lines 3—3 of FIG. 1.

FIG. 4 is a partial elevational view taken along line 4—4 of FIG. 1.

DETAILED DESCRIPTION OF THE INVENTION

Figure 1:
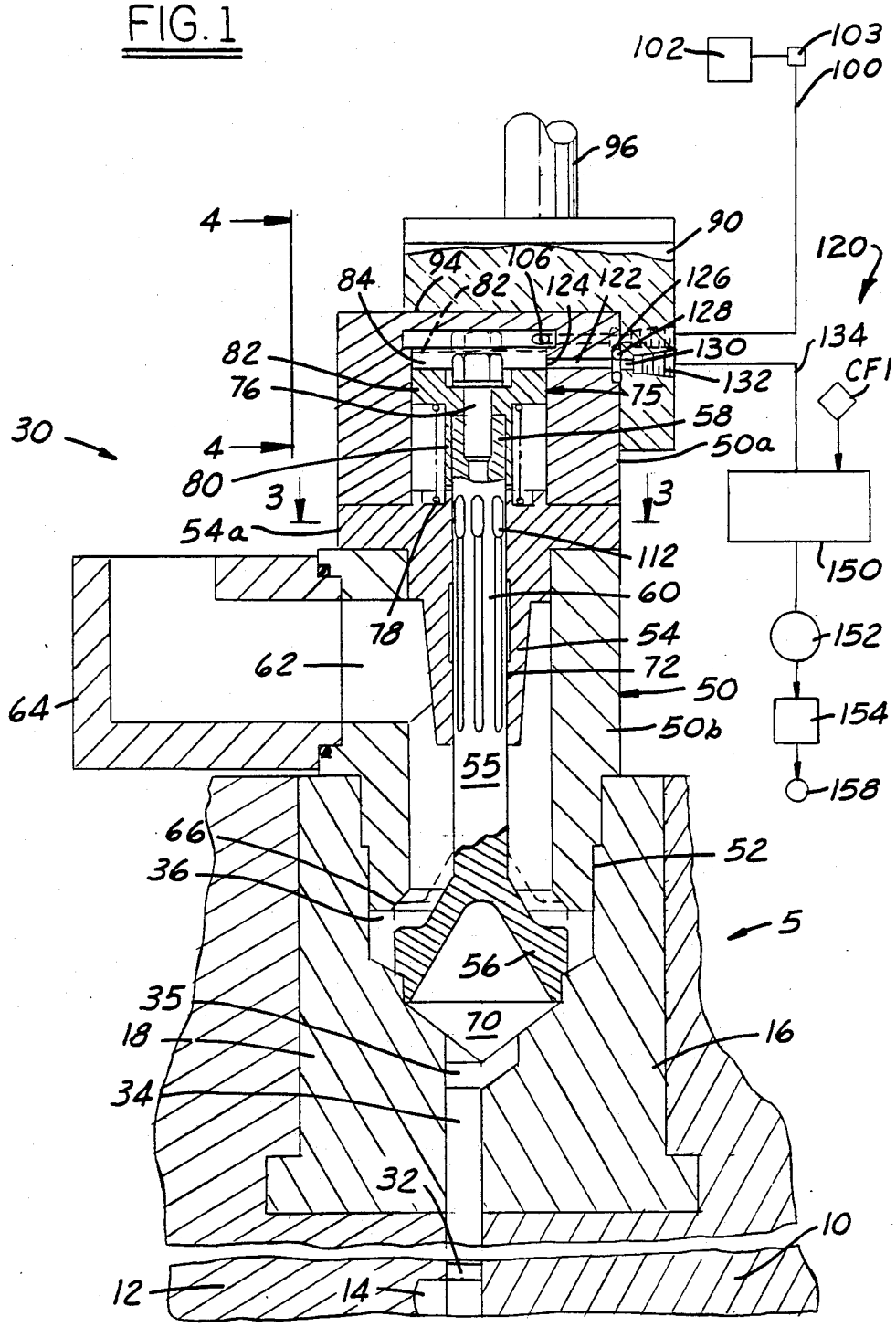
FIG. 1 is a front sectional view of a gas removal system constructed in accordance with the invention to remove gas from a mold cavity and to sense valve position.

FIGS. 1 through 4 illustrate a mold assembly 5 of a die casting machine. The mold assembly includes stationary and movable mold or die halves 10,12 which define a mold cavity 14 therebetween when closed together as shown. Mold halves 10,12 include respective seat members 16,18 which may be integral with the respective mold halves. Mold halves 10,12 and seat members 16,18 are carried on respective stationary and movable platens (not shown).

A gas removal system 30 is provided to remove gas from mold cavity 14. The system includes a first gas discharge passage 32 extending around and from the mold cavity 14 to a second gas discharge passage 34 that includes a pair of bypass passages 35 (only one shown) detouring from the gas vent passage 34 laterally of the valve head and extending to an upper gas discharge chamber 36 to effect gas flow communication between gas vent passage 34 and upper gas discharge chamber 36. Such lateral passages are shown in further detail in the Takeshima et al U.S. Pat. No. 4,538,666 issued Sept. 3, 1985, the teachings of which are incorporated herein by reference. It is apparent that mold halves 10,12 cooperate to form vent passage 32 therebetween while mold halves 10,12 and seat members 16,18 define discharge passage 34 therebetween. Gas discharge chamber 36 is defined between seat members 16,18.

The gas removal system also includes a valve housing or body 50 having end 52 received in gas discharge chamber 36 as shown. Valve body 50 includes upper portion 50*a* and lower portion 50*b* with a valve guide member 54 disposed therebetween. Movably disposed in the valve housing or body 50 is a valve 55 having a lower valve head 56, upper end 58 remote from the valve head and an intermediate valve stem 60. Valve body includes a gas discharge chamber 62 that extends through extension 64 on the valve body and opens outside the mold to vent gas from cavity 14 through gas discharge chambers 36,62 when the valve is in the open position shown in solid in FIG. 1. Alternately, as is known, the extension 64 can be connected to a source of relative vacuum (not shown) to evacuate gases from cavity 14 through gas discharge chambers 36,62 when the valve is open. Valve body 50 includes a valve seat 66 that cooperates with the valve head 56 when the valve is in the closed position shown in phantom in FIG. 1 to prevent interconnection of gas discharge chamber 36 to gas discharge chamber 62.

Movement of valve 55 between the open and closed positions is guided by valve guide member 54. The guide member includes a central axial bore 72 slidably receiving intermediate valve stem 60 to this end. The valve guide member is fastened between the upper and lower portions 50*a*,50*b* by a plurality of machine screws (not shown) extending axially through body portions 50*a*,50*b* and annular flange 54*a* of the valve guide member.

The upper end 58 of the valve includes and has fastened thereto a piston-forming member 75. Machine bolt 76 is provided to fasten the piston-forming member to valve end 58. A coil return spring 78 is disposed between the facing annular shoulders of the piston-forming member 75 and valve guide member 54.

As shown in FIG. 1, valve piston-forming member includes a tubular portion 80 received on valve end 58 and an annular valve piston portion 82 slidably received in a cylinder or chamber 84 defined in the upper portion 50*a* of the valve body.

Valve body 50 is movable toward and away from discharge chamber 36 by means of support frame 90 that includes a T-shaped receptacle 92 to releasably receive and carry upper portion 50*a* of the valve body that is provided with a complementary outer T-shape to this end, e.g., see FIG. 4. A fluid actuated piston 96 is connected to the support frame to move the frame and thus valve body 50 toward the discharge chamber 36 to insert the valve body therein prior to injection of a melt into the mold cavity or away from the discharge chamber 36 to remove the valve body after melt injection to allow removal of a casting or solidified part from the mold cavity by separating movable mold half 12 from stationary mold half 10.

In a typical process sequence for gas removal during die casting, valve 55 is moved from the closed position shown in phantom to the open position shown in solid in FIG. 1 prior to insertion of the valve body 50 is the gas discharge chamber 36 after mold halves 10,12 are closed. Such valve movement is effected by introduction of pneumatic pressure to chamber 84 through pneumatic supply line 100 that is connected to a conventional source 102 of pneumatic pressure. A valve 103 connects supply line 100 to either source 102 or to exhaust. The supply line introduces pneumatic pressure through a supply inlet port 106 communicating to chamber 84.

Although the control valve 55 is described as being moved from the closed position to the open position by introducing pneumatic pressure through inlet port 106, those skilled in the art will appreciate that other means such as hydraulic, mechanical or electrical devices can be used to move the valve.

Once the valve 55 is moved to the open position of FIG. 1, the valve is held in this position by steel balls 110 engaging in grooves 112 in the valve stem 60. Balls 110 are biased against valve stem 60 by coil springs 114. The spring force is adjustable by screws 116 to hold the valve in the open position against bias of spring 78. Balls 110, springs 114 and adjusting screws 116 are disposed in lateral opposed bores in the valve guide member 54 as shown.

Pneumatic supply line 100 and inlet port 106 are connected to exhaust once the valve is moved to the open position and held there by engagement with balls 110.

Movement of valve 55 from the open position back to the closed position shown in phantom is initiated by impingement of the melt or charge injected into the mold cavity 14. As is known, the melt advances into vent passages 32,34 and into impingement chamber 70 against the valve head 56 to initiate valve closing. Return spring 78 assists return of the valve to the closed position to prevent communication between the discharge chamber 36 and 62. As is known, the valve body 50 is withdrawn from gas discharge chamber 36 after melt injection into the mold cavity and mold halves 10,12 are separated so that the solidified casting can be removed from the cavity.

In accordance with the invention, the gas removal system described hereinabove is provided with a valve position sensing mechanism 120 to determine whether the valve is in the open or closed position and to indicate to the die casting machine control unit and/or machine operator the sensed valve position. The valve position sensing mechanism includes a pneumatic or other fluid passage 122 in the upper valve body 50*a* communicating with the cylinder or chamber 84 at an inlet port 124. Passage 122 extends to a counterbore 126 in the upper valve body. An O-ring seal 128 is positioned in the counterbore. As shown best in FIG. 1, passage 122 is in registry with a passage 130 in support frame 90. O-ring seal 128 seals the passages against air leakage at their juncture. Passage 130 terminates in a threaded bore 132 to receive a suitable fitting (not shown) by which pneumatic supply line 134 is connected to passages 122,130 to provide a regulated amount of air at a regulated supply pressure thereto.

As is apparent from FIG. 1, inlet port 124 is positioned in chamber 84 to be uncovered or open for communication with the chamber 84 when the valve 55 is in the open position and to be covered or blocked off by valve piston portion 82 from communicating with the chamber 84 when the valve is at the closed position shown in phantom.

As mentioned hereinabove, pneumatic supply line 100 and associated inlet port 106 are connected to exhaust once the valve 55 is moved to the open position of FIG. 1 and held there by engagement with balls 110.

Supply line 134 is interconnected to passages 122,130 and continuously provides a regulated amount of sensing air at a regulated pressure to chamber 84. When the valve 55 is in the open position shown, the sensing air passes through passages 122,130 into chamber 84 where it freely exhausts out through inlet port 106 which is connected to exhaust except as the valve is moved from the closed to the open position. Since the sensing air freely exhausts out of chamber 84, little or no detectable back pressure is developed in passages 122,130 and supply line 134. Valve 55 in the open position thus establishes a pressure condition in supply line 134 represented by little or no back pressure therein.

However, when the valve 55 is in the closed position, the valve piston portion 82 of the valve covers or blocks inlet port 124 and substantially prevents sensing air from entering chamber 84. Such blocking of the inlet port 124 creates a build-up of back pressure in passages 122,130 and supply line 134. The valve in the closed position thus establishes another pressure condition in supply line 134 represented by the presence of detectable back pressure therein.

The valve position sensing mechanism senses the presence of back pressure or absence of back pressure in passages 122,130 and supply line 134 to determine the position of the valve 55 at either the closed position or open position.

Typically, the regulated pressure of the sensing air provided to supply line 134 is a relatively low pressure of about 90 psi. The regulated amount or flow rate of sensing air typically is about 0.5 to 2.0 cfm.

In general, back pressure in passages 122,130 and supply line 134 actuates pneumatic pressure sensing unit 150 that in turn actuates a pressure switch 152. Pressure switch 152 outputs an electrical signal representative of the valve position to a control unit such as programmable controller 154 which may comprise a programmable computer control unit available as model PLC-230 from Allen Bradley Company, Highland Heights, Ohio.

As explained hereinbelow, controller 154 is programmed to read the signal from pressure switch 152 at one or more times in the die casting process sequence and to compare the valve position signal received with a scheduled valve position for that time in the process sequence stored in the controller memory to determine whether the valve 55 is in proper scheduled position. If the valve is not in proper scheduled position, the controller 154 can actuate an indicator 158, which may be an audible and/or visual indicator, to so inform the machine operator. For example, if the indicator 158 is a light, the light will be actuated by controller 154 when the valve is in the improper position and the light will be off if the valve is properly positioned.

Alternatively, the controller 154 itself may send a suitable command signal to discontinue the process sequence in the event the valve is improperly positioned.

FIG. 2 illustrates in schematic form the sensing components and air logic circuitry employed in the pneumatic pressure sensing unit 150 in relation to pressure limit switch 152.

Air enters line 200 from a conventional compressed air supply (plant supply) CF1 and flows into regulator RF1 and is filtered and regulated to a pre-set regulated pressure such as between about 20 and 50 psi. The air then flows to the air control switch S which must be turned on in order to provide sensing air to sense valve position. This switch S allows regulated pressure air to flow to line 202 when it is closed. Switch S typically is maintained open during operation of the die casting machine to maintain a continuous supply of sensing air to inlet port 124. Switch S may be actuated manually or under the control of controller 154. When the switch is open, air flows out of the switch into line 202 to a distribution block B. Distribution block B then sends the regulated pressure air to four different locations via air lines 204,206,208,210 as explained below. Air line 204 extends to needle valve NV1 which regulates the quantity of air which goes to a T-block 212. Air line 204 splits into two air lines 134 and 205 at the T-block. Line 134 provides air to the valve piston receiving chamber 84 through inlet port 124 and the other air line 205 extends to the control port A of a relay valve RV1.

When the air in line 134 can freely exhaust out of chamber 84 through inlet port 106 (connected to exhaust at that point in time), no back pressure is applied to control port A of relay valve RV1 through line 205. When inlet port 124 is blocked by piston portion 82, back pressure builds up and is applied to control port A of relay valve RV1 and shifts a control spool (not shown) in the relay valve for purposes to be described. Relay valve RV1 is a commercially available relay valve available as model RA7-0105 from Numatics Incorporated, Highland, Mich.

In order to shift the control spool of relay valve RV1, the back pressure in line 134 and hence line 205 must build up to a level sufficient to overcome the control pressure on control port B of the relay valve RV1 that is applied to the control spool. The constant control pressure on control port B of relay valve RV1 is provided through air line 206 which is supplied control pressure from line 202 by regulator R1. Regulator R1 should be set as low as possible so that very little back pressure in line 134 and hence line 205 is required to shift the control spool of relay valve RV1 against the control pressure. However, regulator R1 also should be set to provide sufficient control pressure to shift the control spool of relay valve RV1 back to its original position when back pressure is removed from port A and to overcome any inherent back pressure in the valve position sensing system.

When back pressure in air line 134 to control port A of relay valve RV1 shifts the control spool therein, air from line 202 enters port 3 on relay valve RV1, passes to port 2 and through air line 208 to a time delay device TD1. Time delay device TD1 includes needle valve 207 and check valve 209 in parallel therewith in line 212. Time delay device TD1 permits an adjustable time delay, if desired, before enough air is sent to control port B of relay valve RV2 to shift the control spool valve (not shown) therein. Relay valve RV2 is identical to relay valve RV1.

When the control spool in relay valve RV2 shifts, air is allowed to pass from line 202 on port 1 of relay valve RV2 to port 2 thereof and to line 214. Line 214 conducts the air to the pressure switch 152 and closes the electrical contacts therein. Pressure switch 152 is commercially available as model 836T-T252J from Allen Bradley Compmany.

Pressure switch 152 sends an electrical signal (110 volts) to the controller 154 indicating the presence of back pressure in line 134 and thus that the valve 55 is in the closed position in chamber 84.

When the valve 55 is moved from the closed position to the open position in FIG. 1 (for example, prior to insertion of the valve body 50 into gas discharge chamber 36), the back pressure to control port A on relay valve RV1 is absent or so small as not to be sufficient to overcome the regulated control pressure supplied from regulator R1 to control port B of relay valve RV1. As a result, the control spool of relay valve RV1 shifts to its control position to allow air from line 202 on port 3 of relay valve RV1 to pass to port 4 thereof and hence to line 210. Line 210 then sends air to control port A of relay valve RV2 which shifts or positions its control spool to block air from line 202 on port 1 of relay valve RV2 from passing to port 2 thereof and instead to exhaust the air in line 214 through port 3 of relay valve RV1. This exhausting of air through port 3 of relay valve RV1 relieves the air pressure of pressure switch 152 and opens its electrical contacts so that a "zero volts" signal is sent to controller 154 indicating the absence of back pressure in line 134 and that the valve 55 is in the open position.

Controller 154 has stored in its memory a process sequence for die casting a melt into the mold cavity 14 including coordinated movements of various die casting machine components. This stored sequence includes one or more scheduled positions for valve 55 at one or more times in the process sequence. For example, the valve should be in the open position to allow gas removal from the mold cavity 14 when the mold halves 10,12 are closed and valve body 50 is inserted in air discharge chamber 36 prior to melt injection therein. The controller 154 is also programmed to read the signal from pressure switch 152 at these same times in the process sequence and compare the sensed valve position as indicated by the signal from the pressure switch 152 to such a scheduled valve position stored in the controller memory. If the valve is not properly positioned, controller 154 can actuate indicator 158 as explained hereinabove to so inform the machine operator. In addition or alternately, controller 154 can send a signal to automatically stop injection of melt if the valve is improperly positioned.

As one exemplary illustration, controller 154 can be programmed to read the signal from pressure switch 152 after the mold halves 10,12 are closed and valve body 50 is inserted into gas discharge chamber 36. If the signal indicates the valve 55 is in the open position, indicator 158 will indicate to the machine operator that injection of melt into cavity 14 can proceed. If the signal indicates the valve is in the improper closed position, the indicator 158 will so inform the operator of the improper position.

Although the pressure switch 152 outputs a signal (110 volts or zero volts) indicative of the sensed valve position continuously to controller 154, the controller will read the signal only at the programmed reading time. Thus, any back pressure effect created in supply line 134 when pressure is introduced through inlet port 106 to move the valve from the closed position to the open position will not be read by the controller.

The present invention provides a gas removal system for a mold cavity of a die casting or other molding machine having a mechanism to sense or determine valve position at one or more times during the process sequence and to indicate the sensed valve position to the machine operator and/or machine control unit. As a result, injection of a melt into the mold cavity can be prevented when the valve is in the improper position; e.g., closed instead of open, and the number of scrap parts produced can be reduced.

Although the invention has been described with respect to a gas removal system of the axial melt impingement type, those skilled in the art will appreciate that the invention is useful with other gas removal systems for removing gas from a mold cavity. And, although the inlet port 124 is illustrated as being blocked when the valve is in the closed position, those skilled in the art will appreciate that port 124 instead can be positioned to be open when the valve is closed and to be blocked by the valve when it is open.

Thus, while the invention has been described by a detailed description of certain specific and preferred embodiments, it is to be understood that various modifications and changes can be made therein within the scope of the appended claims which are intended to include equivalents of such embodiments.

The embodiments of the invention in which an exclusive property or privilege is claimed are defined as follows:

1. A gas removal system incorporated with a mold for removing gas from the mold cavity, said system comprising a valve movable to an open position where the mold cavity is interconnected with gas discharge means or to a closed position where the mold cavity is not so interconnected, means for moving the valve to the closed position or open position, and a valve position sensing mechanism having means for forming a chamber in which the valve is movable to a first position representative of the valve closed position or a second position representative of the valve open position, a fluid pressure supply having an inlet to the chamber and relative to which inlet the valve moves to establish a first pressure condition in the supply when the valve is in the first position in the chamber and a second pressure condition when the valve is in the second position in the chamber, and means for sensing the established pressure condition in the supply as a result of said valve being moved to the closed position or the open position and for thereby sensing valve position.

2. The system of claim 1 wherein said valve position sensing mechanism further includes means for comparing the sensed valve position with a scheduled valve position and indicating when the sensed position does not correspond to the scheduled position.

3. A gas removal system incorporated with a mold for removing gas from the mold cavity, said system comprising a valve movable to an open position where the mold cavity is interconnected with gas discharge means or to a closed position where the mold cavity is not so interconnected, means for moving the valve to the closed position or open position, and a valve position sensing mechanism having means for forming a chamber in which the valve is movable to a first position representative of the valve closed position or a second position representative of the valve open position, a fluid pressure supply having a first inlet to the chamber and relative to which inlet the valve moves to establish back pressure in the supply when the valve is in one of said first position or second position in the chamber and substantially no back pressure when the valve is in the other of said first position or second position in the chamber, and means for sensing presence or absence of back pressure in the supply as a result of said valve being moved to the closed position or the open position and for thereby sensing valve position.

4. The system of claim 3 wherein said means for moving the valve comprises said chamber constituting a fluid cylinder and a second fluid pressure supply having a second inlet for introducing fluid pressure in the chamber to move the valve as a piston therein.

5. The system of claim 4 wherein the second inlet alternately is interconnected to a fluid pressure exhaust to exhaust fluid pressure entering said chamber through said first inlet when the valve position is sensed.

6. The system of claim 3 wherein said valve position sensing mechanism further includes means for comparing the sensed valve position with a scheduled valve position and indicating when the sensed position does not correspond to the scheduled position.

7. A gas removal system incorporated with a mold for removing gas from the mold cavity, said system comprising a valve movable to an open position where the mold cavity is interconnected with gas discharge means or to a closed position where the mold cavity is not so interconnected, means for moving the valve to the closed position or open position, and a valve position sensing mechanism having means for forming a chamber in which the valve is movable to a first position representative of the valve closed position or to a second position representative of the valve open position, a fluid pressure supply having an inlet to the chamber, said inlet being positioned in the chamber so as to be blocked by said portion of the valve for communicating with the chamber to establish a back pressure in the supply when said portion is in the first position and so as to be in open communication with the chamber when said portion is in the second position, a fluid pressure exhaust having an outlet in communication with the chamber for exhausting pressure from the chamber when said inlet is in communication therewith such that substantially no back pressure is established when said portion is in the second position, and means for sensing presence or absence of back pressure in the supply as a result of said valve being moved to said closed position or open position and thereby sensing valve position.

8. The system of claim 7 wherein said means for moving the valve comprises said chamber constituting a fluid cylinder and a second fluid pressure supply having a second inlet for introducing fluid pressure in the chamber to move said portion of the valve as a piston.

9. The system of claim 8 wherein the second inlet alternately comprises said fluid pressure exhaust for exhausting fluid pressure from the chamber when the valve position is sensed.

10. The system of claim 7 wherein the valve position sensing mechanism further includes means for comparing the sensed valve position with a scheduled valve position and indicating when the sensed position does not correspond to the scheduled position.

11. In a method for removing gas from a mold cavity by moving a valve to an open position where the mold cavity is interconnected with gas discharge means or to a closed position where the mold cavity is not so interconnected, the step of sensing the position of the valve in the open position or closed position by supplying fluid pressure to an inlet, moving the valve relative to the inlet such that the valve established a first pressure condition when it is in the closed position and a second pressure condition when it is in the open position, and sensing the established pressure condition to determine valve position.

12. The method of claim 11 wherein the first pressure condition and second pressure condition are established in a supply line to said inlet.

13. The method of claim 12 wherein the first pressure condition established is represented by the presence of back pressure in the supply line and the second pressure condition established is represented by the substantial absence of back pressure in the supply line.

* * * * *